US006615741B2

(12) United States Patent
Fecko et al.

(10) Patent No.: US 6,615,741 B2
(45) Date of Patent: Sep. 9, 2003

(54) COMPOSITE RAILCAR CONTAINERS AND DOOR

(75) Inventors: Joseph V. Fecko, Auburn, CA (US); William R. Galbraith, Portland, OR (US); Kurt Jordan, Mill Valley, CA (US)

(73) Assignee: American Composite Materials Engineering, Inc., Marysville, CA (US)

( * ) Notice: Subject to any disclaimer, the term of this patent is extended or adjusted under 35 U.S.C. 154(b) by 0 days.

(21) Appl. No.: 09/849,150

(22) Filed: May 4, 2001

(65) Prior Publication Data

US 2002/0046678 A1 Apr. 25, 2002

Related U.S. Application Data

(60) Provisional application No. 60/201,877, filed on May 4, 2000.

(51) Int. Cl.[7] ..... B61D 17/00

(52) U.S. Cl. ..... 105/404; 62/239; 220/1.5

(58) Field of Search ..... 105/397, 401, 105/404, 396, 355; 62/239; 220/1.5

(56) References Cited

U.S. PATENT DOCUMENTS

| | | | | | |
|---|---|---|---|---|---|
| 2,034,081 | A | | 3/1936 | Bonsall | 108/5.4 |
| 2,513,829 | A | | 7/1950 | Vaughn | 108/5.4 |
| 2,529,641 | A | | 11/1950 | Torburn | 105/363 |
| 2,536,241 | A | | 1/1951 | Williamson et al. | 62/91.5 |
| 2,966,436 | A | | 12/1960 | Fox et al. | 154/45.9 |
| 3,029,172 | A | | 4/1962 | Glass | 154/45 |
| 3,059,734 | A | | 10/1962 | Tripp | 189/34 |
| 3,175,606 | A | | 3/1965 | Talmey et al. | 165/41 |
| 3,429,083 | A | | 2/1969 | Voros | 52/53 |
| 3,598,273 | A | | 8/1971 | Skokie et al. | 220/1.5 |
| 3,823,518 | A | | 7/1974 | Allen | 52/53 |
| 3,995,081 | A | | 11/1976 | Fant et al. | 428/119 |
| 4,020,603 | A | | 5/1977 | Austill | 52/53 |
| 4,046,186 | A | | 9/1977 | Nordstrom | 160/368 R |
| 4,369,608 | A | | 1/1983 | Miura et al. | 52/309.9 |
| 4,467,612 | A | * | 8/1984 | Weasel, Jr. | 62/239 |
| 4,478,155 | A | * | 10/1984 | Cena et al. | 105/355 |
| 4,498,306 | A | | 2/1985 | Tyree, Jr. | 62/119 |
| 4,575,148 | A | | 3/1986 | Bieber | 296/210 |
| 4,593,536 | A | | 6/1986 | Fink et al. | 62/239 |
| 4,599,257 | A | | 7/1986 | Nutt | 428/131 |
| 4,608,931 | A | | 9/1986 | Ruhmann et al. | 105/248 |
| 4,787,532 | A | | 11/1988 | Borjesson | 220/410 |
| 4,795,047 | A | | 1/1989 | Dunwoodie | 220/1.5 |
| 4,811,540 | A | | 3/1989 | Kallies et al. | 52/630 |
| 4,860,911 | A | * | 8/1989 | Jones, Sr. | 220/1.5 |
| 4,891,954 | A | | 1/1990 | Thomsen | 62/239 |
| 4,930,661 | A | * | 6/1990 | Voorhies | 220/1.5 |
| 4,951,479 | A | | 8/1990 | Araquistain et al. | 62/239 |
| 5,029,936 | A | | 7/1991 | Gonzalez | 296/210 |
| 5,042,395 | A | | 8/1991 | Wackerle | 105/397 |
| 5,066,067 | A | | 11/1991 | Ferdows | 296/197 |
| 5,168,717 | A | | 12/1992 | Mowatt-Larssen | 62/239 |
| 5,255,806 | A | * | 10/1993 | Korzeniowski et al. | 220/1.5 |
| 5,323,622 | A | * | 6/1994 | Weiner et al. | 62/239 |
| 5,383,406 | A | | 1/1995 | Vanolo et al. | 105/401 |
| 5,392,717 | A | | 2/1995 | Hesch et al. | 105/404 |
| 5,397,201 | A | | 3/1995 | Novak et al. | 405/195.1 |
| 5,415,009 | A | | 5/1995 | Weiner et al. | 62/239 |
| 5,450,977 | A | | 9/1995 | Moe | 220/467 |

(List continued on next page.)

*Primary Examiner*—S. Joseph Morano
*Assistant Examiner*—Lars A. Olson
(74) *Attorney, Agent, or Firm*—Kolisch Hartwell, P.C.

(57) ABSTRACT

Composite flatbed and well car railcar containers are disclosed herein, as well as modular containers formed from prefabricated side, end, top and bottom panels. In some embodiments, the container is a temperature-controlled container. The present invention is also directed to an improved door for use on the invented containers, as well as conventional containers and railcars.

50 Claims, 7 Drawing Sheets

U.S. PATENT DOCUMENTS 5,460,013 A 10/1995 Thomsen ..... 62/239
5,513,595 A 5/1996 Chatterton ..... 119/412
5,555,733 A 9/1996 Claterbos et al. ..... 62/62
5,584,188 A 12/1996 Tippmann et al. ..... 62/239
5,642,827 A * 7/1997 Madsen ..... 220/1.5
5,660,057 A 8/1997 Tyree, Jr. ..... 62/384
5,690,378 A 11/1997 Romesburg ..... 296/181
5,702,151 A 12/1997 Grote et al. ..... 296/187
5,802,984 A 9/1998 Thoman et al. ..... 105/404
5,816,423 A * 10/1998 Fenton et al. ..... 220/1.5
5,857,414 A 1/1999 Thoman et al. ..... 105/397
5,916,093 A 6/1999 Fecko et al. ..... 52/17
5,946,933 A * 9/1999 Clarke et al. ..... 62/239
5,953,928 A * 9/1999 Saia et al. ..... 62/239
5,987,910 A * 11/1999 Kothe et al. ..... 62/239
5,988,074 A 11/1999 Thoman ..... 105/404
6,092,472 A 7/2000 Thoman et al. ..... 105/404

* cited by examiner

COMPOSITE RAILCAR CONTAINERS AND DOOR

RELATED APPLICATION

This application claims priority to U.S. Provisional Patent Application Serial No. 60/201,877, which was filed on May 4, 2000, is entitled "Improved Railcar Container and Door," and the complete disclosure of which is hereby incorporated by reference for all purposes.

FIELD OF THE INVENTION

The invention relates generally to railcars, and more particularly to railcar containers and an improved door for railcars and railcar containers.

BACKGROUND OF THE INVENTION

Railcars take a variety of forms, such as passenger cars that carry travelers, hopper cars that carry grain, sand, dirt or other particulate materials, boxcars that define enclosed storage compartments into which cargo may be loaded, and container cars that are adapted to receive large cargo containers filled with items to be transported. Examples of container cars include flatcars and well cars. A flatcar, or flatbed car, is a type of railcar that has a planar container-supporting surface mounted on a lower frame and wheel assembly. Much like a flatbed truck, the container-supporting surface does not have sidewalls and therefore is open laterally on its sides.

A well car is similar to a flatcar, except that the container-supporting surface is recessed into the frame of the car and generally between the wheel assemblies, thereby defining a sidewalls and end walls that define a raised perimeter around the lower portion of a container, semi truck trailer, or other cargo loaded into the well car's container supporting surface. Because the container-supporting surface is recessed within the frame, typically approximately nine to twelve inches above the rails upon which the car travels, well cars may support stacked containers, trailers or the like without exceeding a maximum acceptable height. For example, one company that produces well cars is Gunderson, Inc., which sells railcars under the trade names HUSKY-STACK and MAXI-STACK.

Railcar containers are typically constructed of steel and it is this steel construction that contributes to a number of disadvantages of existing containers, any one or more of which may be solved by the present invention. Examples of disadvantages of steel containers are the significant weight of the empty container as a result of the steel used to form the container, the vulnerability of the container to leaks that may result in damage to the materials being transported therein, the heat absorption because of the steel construction, and the ease at which the containers may be deformed and otherwise damaged during loading and unloading of materials.

SUMMARY OF THE INVENTION

The present invention is directed to composite railcar containers that overcome one or more of the above-discussed disadvantages of conventional steel containers. Both flatbed and well car containers are disclosed herein, as well as modular containers formed from prefabricated side, end, top and bottom panels. In some embodiments, the container is a temperature-controlled container. The present invention is also directed to an improved door for use on the invented containers, as well as conventional containers and railcars.

Many other features of the present invention will become manifest to those versed in the art upon making reference to the detailed description which follows and the accompanying sheets of drawings in which preferred embodiments incorporating the principles of this invention are disclosed as illustrative examples only.

DETAILED DESCRIPTION AND BEST MODE OF THE INVENTION

Figure 1:
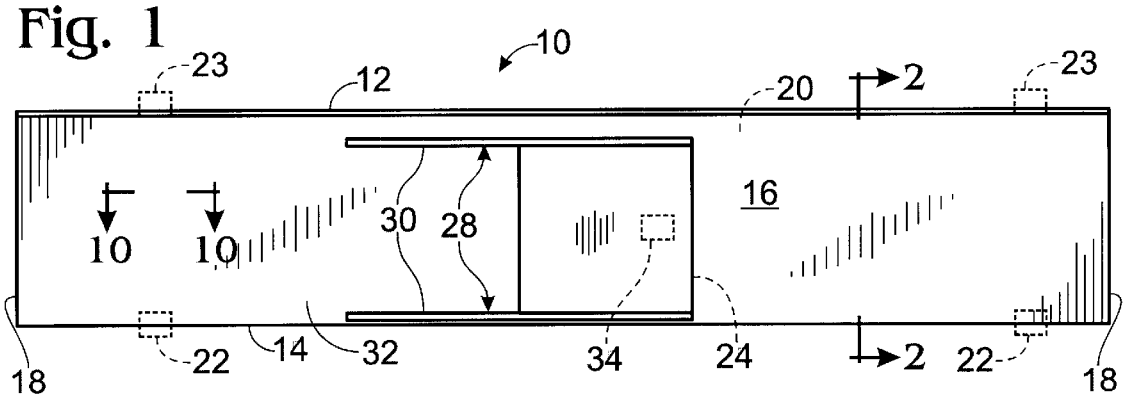
FIG. 1 is a side elevation view of a composite railcar container constructed according to the present invention.

A railcar container constructed according to the present invention is shown in FIG. 1 and generally indicated at 10. As shown, container 10 includes top, bottom, side and end walls or panels 12–18, respectively. Panels 12–18 define an internal compartment or storage area 20, in which cargo to be transported is stowed. Container 10 is at least substantially formed of a composite fiberglass material. In some embodiments, the container is completely formed of a composite fiberglass material. It should be understood that any suitable type and composition of fiberglass material may be used. Composite fiberglass material may also be referred to as fiber-reinforced plastic, and typically includes fiber-reinforced polyester, vinyl ester, isophthalic or orphthalic resins. A Quad-mat fiberglass material, such as is available from Owens Corning and Vetrotex has proven effective, but others may be used.

Because of the substantially lighter construction of container 10 as compared to conventional steel containers, container 10 offers the advantage of selectively being much larger than conventional steel containers. Of course, sizing container 10 to at least generally, or completely, correspond with the dimensions of conventional steel containers is also within the scope of the present invention, as well as containers that are smaller than conventional steel containers. Another advantage of a composite fiberglass material of construction is its resiliency when struck by materials being transported, forklifts used to load and unload materials, etc. Whereas steel containers tend to permanently deform and/or rip, containers according to the present invention momentarily deflect under the applied force, and then return to their original configuration when the force is removed.

As discussed in more detail herein, the walls or panels may, in some embodiments, include an insulating material. Similarly, at least bottom wall 14 may include one or more support structures that are formed from foam, metal, wood or other suitable materials to increase the strength of that wall.

The bottom wall, or bottom panel, of container 10 should be constructed to support a load of at least 30,000 pounds per square foot. Preferably, the floor is adapted to support 60,000 pounds per square foot or more, and even more preferably, to support at least 90,000 pounds per square foot or more. By way of comparison, conventional steel containers are designed to support loads of 60,000 pounds per square foot. Bottom wall 14 typically will also include lock mechanisms 22 that are adapted to secure the container to corresponding lock mechanisms on the container car and/or on the top walls of another container. Similarly, the container car and optionally the top walls of the containers may have corresponding lock mechanisms 23 that are adapted to interlock with lock mechanisms 22 to secure either a container on the container car or two containers together. Lock mechanisms 22 and 23 may have any suitable configuration, such as those known in the art. Similarly, the portions of lock mechanisms 22 and 23 associated with container 10 may be recessed within the walls of the container or may project from the container. Examples of suitable lock mechanism are produced by Holland Company of Crete, Ill., although other mechanisms and types of mechanisms may be used. In FIG. 1, lock mechanisms 22 and 23 are schematically illustrated on top and bottom walls 12 and 14, but it should be understood that it is within the scope of the present invention that a container may include lock mechanisms only on its bottom wall, a lock mechanism on its side or end walls, or no lock mechanism.

Figure 21:
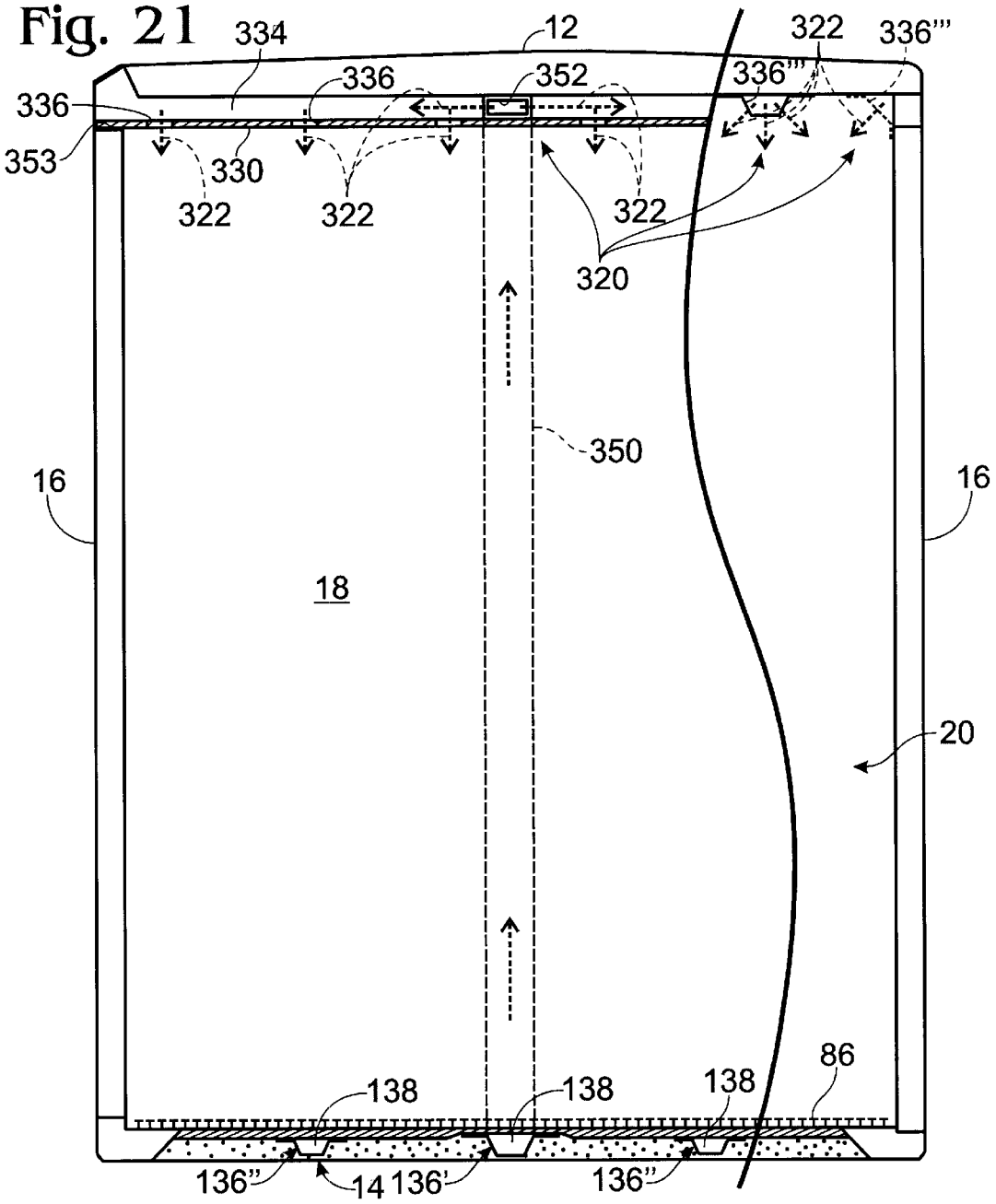
FIG. 21 is a cross-sectional view of the container of FIG. 20.

The top wall, or top panel, of container 10 may have any suitable construction, including a crowned, or arched, configuration, such as shown in FIG. 21. Non-exclusive examples of suitable top walls 12 are disclosed in U.S. patent application Ser. No. 09/327,037, which was filed on Jun. 7, 1999, is entitled "Composite Fiberglass Railcar Roof," and the complete disclosure of which is hereby incorporated by reference for all purposes. When two or more containers according to the present invention are adapted to be stacked on top each of each other, the sidewalls, ends walls and top wall should be sufficiently strong to support the weight of the one or more additional containers, and optionally, the predetermined maximum loads that may be contained in those containers.

Also shown in FIG. 1 is an opening 24 that provides a portal through which cargo to be transported may be loaded into and removed from container 10. Opening 24 should be sufficiently large to permit an individual carrying cargo to be transported to enter and exit the container. Preferably, opening 24 is sized to permit dollies, forklifts and other cargo-carrying devices to pass through the opening. For example, opening 24 may be approximately 8–12 feet wide and high, although other dimensions may be used and are within the scope of the invention.

Container 10 further includes a door 26, that selectively closes, or obstructs, opening 24. Preferably, door 26 is sized to at least substantially or even completely obstruct or close the opening. In some embodiments, door may be configured to provide an air-tight seal with the wall in which opening 24 is formed so that air and air-borne materials cannot enter and exit the container through opening 24 when the door is in its closed position. Door 26 may have any suitable construction and may be formed of any suitable materials, such as metal, a composite fiberglass material, or combinations thereof. Door 26 may be coupled to container 10 by any suitable mechanism that enables the door to be selectively moved between the closed position described above and an open position, in which the opening is at least substantially or completely unobstructed by the door and its corresponding coupling structure. Examples of suitable doors and mounting assemblies therefore are produced by the Youngstown Steel Door Company and are disclosed in U.S. Pat. No. 4,064,810, the disclosure of which is hereby incorporated by reference.

An example of a suitable coupling structure 28 is shown in FIG. 1 and consists of rails, or tracks, 30 that extend along the outer surface 32 of sidewall 16. In the open position, door 26 extends generally parallel and exterior to sidewall 16. To close the door, the door is slid along rails 30 to its closed position, in which the door either overlies opening 24, or preferably, in which the door travels at least partially into the opening, such as to be generally coplanar with sidewall 16. Door 26 may also include a lock mechanism 34 that enables the door to be selectively locked in its closed position to prevent unauthorized access to compartment 20.

Container 10 may have a single door 26, such as shown in FIG. 1. Alternatively, container 10 may have a pair of opposing doors 26, with one door on each of sidewalls 16, such as indicated in dashed lines in FIG. 2. As still another alternative, container 10 may have more than one door on at least one of its walls. When container 10 includes more than one door, the doors may be of the same or different sizes and may have the same or different construction and coupling structures.

Container 10 may be formed in a variety of sizes. Typically, the container is approximately 9–10 feet in width, approximately 7–16 feet in height and approximately 18–80 feet long. The dimensions of a particular container may be selected based upon a combination of factors that include a manufacturer's production capabilities, the intended use or range of uses of the container and user preferences. For example, industry standards in the railcar industry dictate that railcars and containers mounted thereupon not be wider than 10 feet. Therefore a container according to the present invention may be 10 feet wide. Alternatively, the container may be slightly less than 10 feet wide to permit a perimeter flange or the sidewalls of a well car to extend partially along the side of the container. As another example, current industry standards dictate that railcars, including any containers or other objects mounted thereupon, not extend more than 17 feet above the ground or rail surface. The container-supporting surface of a flat bed car tends to be approximately 40 inches above the rail surface, while the container-supporting surface of a well car tends to be approximately 9–12 inches above the rail surface. Therefore, a container according to the present invention may vary in height in the range of approximately 7 or 8 feet to approximately 16 feet, with 9- and 12–13-foot heights being examples of heights within this range. In some applications, the containers may also be stacked on top of each other.

The length of a container according to the present invention will typically be at least 18 feet long, and will typically be less than 70 feet long. Containers that are also able to be used on seacraft typically will be 40 feet in length or less. Containers that also are able to be used on semi trucks will be 53 feet in length or less. In Europe, containers typically are approximately 40–42 feet in length or less. Other examples of suitable container lengths include 20, 24, 28, 40, 45, 48, 53 and 56 feet.

Sometimes it is desirable to position two or more containers on a container car in an end-to-end relationship, and accordingly, the length of such containers should each be no more than an incremental portion of the available length of the container car upon which the containers may be used. For example, if a container car is 72 feet long and has a container-supporting surface that is 65 feet long, a container constructed for use on that car may be approximately 64 feet long. When two containers are intended to be used on that car, then the containers may each be approximately 32 feet long, or three containers that are each approximately 21 feet long, etc.

It should be understood that these dimensions are intended to provide illustrative examples of some suitable dimensions, but that dimensions outside of these examples and incrementally within these examples are within the scope of the present invention.

Figure 2:
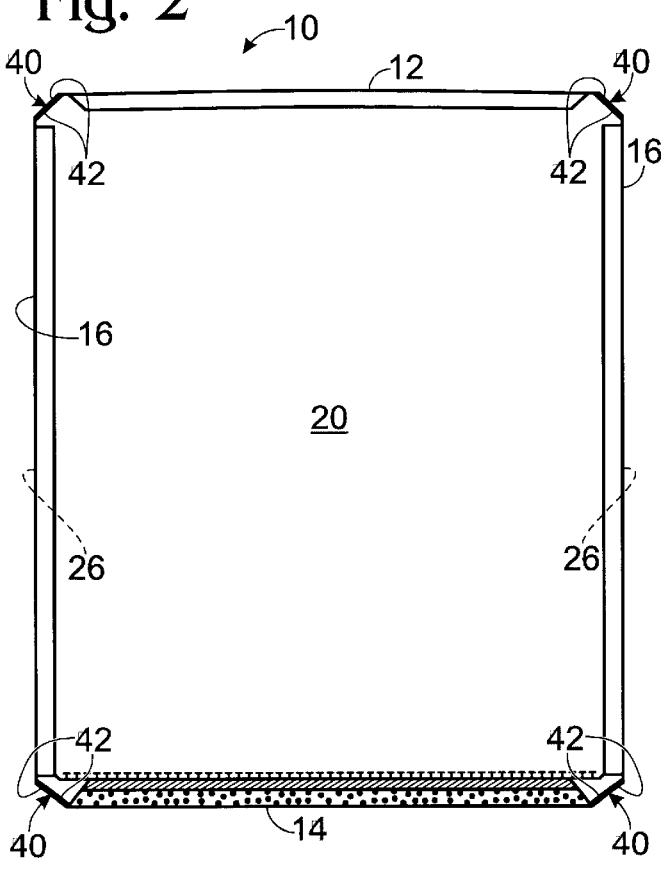
FIG. 2 is a cross-sectional view of the container of FIG. 1 taken along the line 2—2 in FIG. 1.

In some embodiments, container 10 may be referred to as a modular container because it is assembled from separately formed bottom, side, end and top panels 12–18 that define the container's storage area 20. As shown in FIG. 2, walls 12–18 are separately formed from each other and joined together at joints 40, in which corresponding perimeter portions 42 of adjoining walls overlap or abut each other. Perimeter portions 42 may also be described as edge regions, or flanges. Walls 12–18 may also be described as being modular walls or modular panels because they may be produced independent of the other walls. Containers 10 according to the present invention may then be assembled from separately formed end, top, bottom and sidewalls. In the illustrated embodiment, container 10 is formed from six modular walls, namely top wall 12, bottom wall 14, two sidewalls 16 and two end walls 18. However, it is within the scope of the present invention that at least one of the walls may be formed from two or more discrete, modular portions that are joined together during assembly of the car, and that two or more of the walls may be formed together as a modular or integral component.

Figure 3:
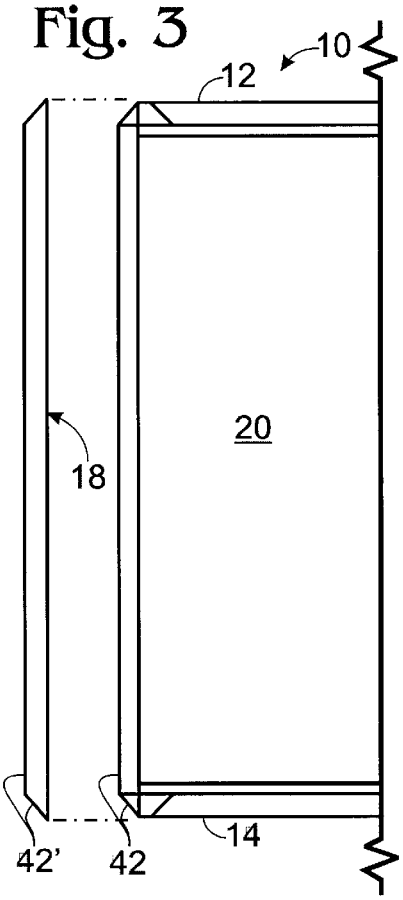
FIG. 3 is a fragmentary cross-sectional view of the container of FIG. 1.
Figure 6:
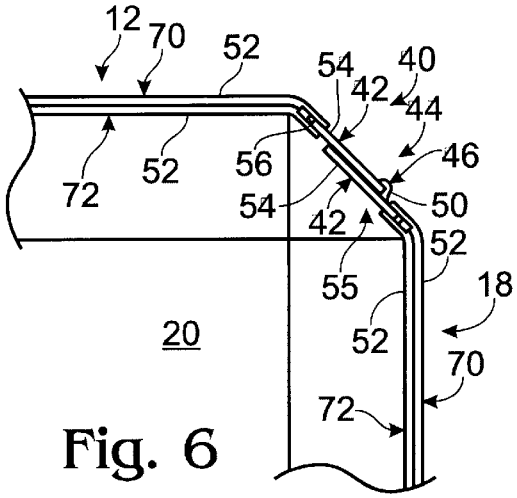
FIG. 6 is an enlarged cross-sectional detail showing another embodiment of a suitable corner joint for the container of FIGS. 1–3.
Figure 7:
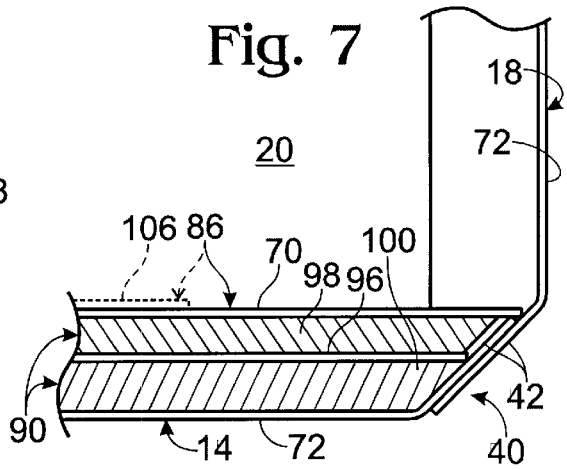
FIG. 7 is an enlarged cross-sectional detail showing another embodiment of a suitable corner joint for the container of FIGS. 1–3.

In FIG. 3, an example of a modular end wall 18 is shown. The embodiment of end wall shown in FIG. 3 may be described as a cap-style end wall, or as a end cap because the perimeter portions of end wall 18, which are indicated at 42' in FIG. 3, define a concave structure that extend over the corresponding perimeter portions 42 of the top, bottom and sidewalls. In a variation of this embodiment, the end wall may be described as a plug-style end wall, or end plug, with portions 42 extending over the corresponding portions 42' of the end wall. In FIGS. 6 and 7, examples of the plug- and cap-style end walls are illustrated respectively. In still a further variation, portions 42 and 42' may be joined together in other relationships, such as a mix of overlapping and underlapping configurations. End walls that do not define concave structures are also within the scope of the present invention.

The modular walls are secured together with any suitable fastening mechanism 44. Illustrative examples of a suitable fastening mechanisms 44 are shown in FIGS. 4–9 and are shown joining various combinations of top, bottom, side and end walls together. It should be understood that any of the fastening mechanisms shown in FIGS. 4–9 and described herein may be used to join any combination of these walls or panels together. However, for purposes of brevity every possible permutation has not been illustrated. Similarly, the wall constructions shown in FIGS. 4–9 are not exclusive to the particular walls illustrated therein, and may be used on any of walls 12–18.

Figure 4:
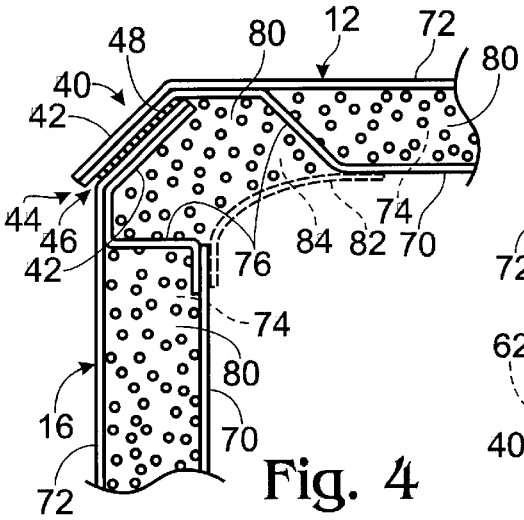
FIG. 4 is an enlarged cross-sectional detail showing an upper corner joint of the container of FIG. 2.

An example of a suitable fastening mechanism 44 is a non-penetrating fastening mechanism 46. By "non-penetrating" fastening mechanism, it is meant that the fastening mechanism does not extend through one or more of the perimeter portions 42 to be joined. An example of a non-penetrating fastening mechanism 46 is an adhesive 48, such as shown in FIG. 4. The term "adhesive" is meant to include both settable and curable materials that secure portions 42 as the material sets and/or cures, as well as materials that chemically interact with portions 42 to bond the portions together. Another example of a non-penetrating fastening mechanism is a weld 50, such as shown in FIG. 6. In FIG. 6, portions 42 include layers 70 and 72 of composite fiberglass material 52, but also metal portions 54 that extend from material 52 to form a weldable region 55. Metal portions 54 may be secured to the fiberglass material by any suitable mechanism, such as by sandwiching the metal portion between layers of the fiberglass material before or while the material cures. An even stronger bond is produced when the metal portion includes one or more apertures 56 through which the fiberglass material may extend prior to curing. The above-incorporated U.S. patent application Ser. No. 09/327,037 discloses examples of suitable weldable portions.

Figure 5:
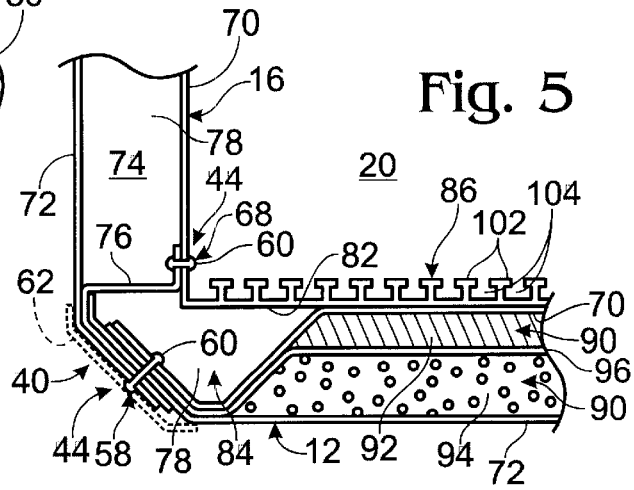
FIG. 5 is an enlarged cross-sectional detail showing a lower corner joint of the container of FIG. 2.

Another example of a suitable fastening mechanism 44 is a penetrating fastening mechanism 58. By "penetrating," it is meant that the fastening mechanism extends through at least one of perimeter portions 42. Examples of suitable penetrating fastening mechanisms 58 include screws, bolts, rivets, and huck rivets, such as shown in FIG. 5 and illustrated generally at 60. FIGS. 4 and 5 also demonstrate that joints 40 may be thinner in cross-section than the corresponding walls, such as shown in FIG. 4 in which the walls each taper to a relatively thin flange portion, or that the joints may be at least as thick in cross-section as the corresponding walls, such as shown in FIG. 5.

Figure 8:
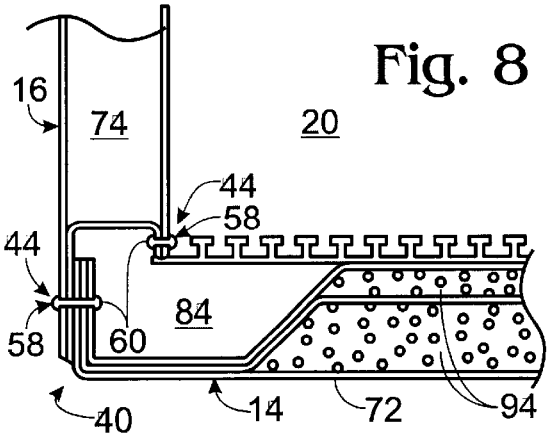
FIG. 8 is an enlarged cross-sectional detail showing another embodiment of a suitable corner joint for the container of FIGS. 1–3.
Figure 9:
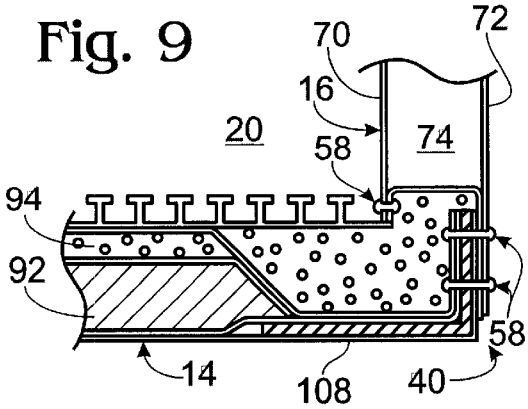
FIG. 9 is an enlarged cross-sectional detail showing another embodiment of a suitable corner joint for the container of FIGS. 1–3.

FIGS. 5 and 8–9 also demonstrate that more than one fastening mechanism may be used at each joint. In FIG. 5, plural penetrating fastening mechanisms 58 are shown. FIG. 5 also illustrates in dashed lines that joints 40 may include a cover, or lap portion, 62 that extends over fastening mechanism to protect the fastening mechanism and to provide an additional barrier to air, water and other contaminants entering container 10 through the joint. Cover 62 may be secured to the container via any suitable mechanism, such as by forming the cover from material 52 and joining the cover prior to curing or with an adhesive after the cover has cured. It should be understood that fastening mechanism may be used at spaced-apart intervals along the length of the joint, and/or continuously along the length of the joint. Typically, non-penetrating fastening mechanisms will be used continuously along joints 40, and penetrating fastening mechanisms will be used in spaced-apart intervals along the length of joints 40.

FIGS. 4–9 also illustrate various combinations of suitable wall constructions according to the present invention. For example, in FIGS. 4 and 5, walls 12, 14 and 16 are shown containing spaced-apart layers 70 and 72 of a composite fiberglass material 52 that define a cavity 74 therebetween. As also shown, the edges 76 of the cavity may be sealed. The cavity may be filled with air or another insulating gas 78, such as shown in FIG. 5. In such an embodiment, and when it is desired for container 10 to be an insulated container, cavity 74 is preferably (but not necessarily) air-tight to increase the insulating capacity of the wall. Alternatively, cavity 74 may be filled with a solid insulating material 80, such as shown in FIG. 4. An example of a suitable solid insulating material is preformed or injected foam. Examples of suitable insulating foams include 1- and 2-pound polyurethane, but others may be used and are within the scope of the present invention.

In some embodiments of the invention, such as when it is desired to provide an insulated or refrigerated container, joints 40 may also be insulated. Of course, it is also within the scope of the invention that the joints are not insulated, such as shown in FIG. 6. An example of an insulated joint 40 is provided in FIG. 4. As shown, an internal cover 82 extends between layers 72 of the walls forming joint 40, such as walls 12 and 16. Cover 82 defines a joint cavity 84, which may be either gas-filled or filled with a solid insulating material, such as discussed above with respect to cavity 74. It is also within the scope of the invention that a solid insulating material may be applied on the underside of joint 40, without requiring internal cover 82. Internal cover 82 may also be formed from one of the walls, such as shown in FIG. 5, in which the floor, or cargo-supporting surface, 86 of bottom wall 14 defines internal cover 82. As another example, the joint may be insulated by an extension of at least one of the walls being joined at the joint. An example of such an embodiment is shown in FIG. 7, in which lower wall 14 extends beneath joint 40 to provide insulation to the joint.

In FIGS. 5 and 7–9, examples of suitable constructions for bottom wall 14 are shown. As discussed previously, wall 14 should be constructed of sufficient strength to support the weight of the cargo loaded into storage area 20. A suitable construction for bottom wall 14 is to enclose or layer a support structure between layers of composite fiberglass material 52. An example of such a construction is shown in FIG. 5, in which wall 14 includes support structures 90 sandwiched or layered between fiberglass material 52. In the particular embodiment shown, wall 14 includes a pair of support structures 92 and 94, between layers 70, 72 and an intermediate layer 96 of composite fiberglass material 52. Support structures 90 may be formed of any suitable material that adds the desired strength to wall 14. Examples of suitable materials are cellulosic materials, such as wood and wood products, as illustrated at 92 in FIG. 5, and foamed materials, as indicated at 94 in FIG. 5. Balsa has proven to be an effective cellulosic material 92, although others may be used, and the 2-pound polyurethane discussed above has proven to be an effective foamed material 94, although others may be used. Other examples of support structures include metal, cured resins and polymers, and plastic.

The balsa and foam construction shown in FIG. 5 provides a bottom panel 14 that is configured to support 90,000 pounds per square foot, although it is within the scope of the present invention that the bottom or other walls may be constructed to support greater or lesser loads. It is also within the scope of the present invention that bottom wall 14 may include only a single enclosed support structure 90, or more than the pair of support structures shown in FIG. 5. Similarly, each support structure may be formed from a single material, or a combination of materials, such as those discussed above and herein. To illustrate that a variety of constructions may be used for bottom wall 14, FIG. 7 demonstrates a bottom panel having a pair of non-foamed support structures 98 and 100, FIG. 8 demonstrates a pair of foamed support structures 94, and FIG. 9 demonstrates a construction similar to FIG. 5, except that the order of the foamed and cellulosic portions has been reversed. Although discussed herein in the context of bottom wall 14, it should be understood that any of the other walls, or panels, may have the same or a similar construction.

In FIG. 5, the cargo-supporting surface 86 of container 10 is shown. In FIG. 5, surface 86 includes elevated risers 102 that define passages 104 beneath the risers. The passages may be used to provide an airflow path for cooling or heating the cargo in the container. In FIG. 5, surface 86 has a generally T-shaped configuration, and may be formed in extruded sheets of material, such as aluminum. Alternatively, surface 86 may be formed as a planar surface that does not include recessed passages 104, such as shown in FIG. 7, in which layer 70 forms the cargo-supporting surface. It is also within the scope of the invention that surface 86 may be a generally planar surface overlaid upon layer 70, such as shown in dashed lines in FIG. 7 at 106. When bottom wall 14 includes joints of reduced thickness than the rest of the wall, a construction similar to that shown in FIG. 4 may be used to fill and insulate the joints.

In FIG. 9, the container is shown including corner braces 108 that reinforce the corner of the container. An example of a suitable material for braces 108 is steel, but others may be used. Containers according to the present invention may include corner braces at every joint 40, at only some of the joints (such as the lower joints), or at none of the joints.

Turning now to FIGS. 10–13, additional views of suitable constructions for walls 12–18 are shown. To illustrate that any of walls 12–18 may have these constructions, various ones of reference numerals 12–18 are used with respect to FIGS. 10–13. It is within the scope of the present invention that walls 12–18 may have the same or different thicknesses and configurations. In experiments, 4- and 6-inch thicknesses have proven effective, but it is within the scope of the invention that thicknesses within and between these values may be used. For example, sidewalls 16 may have 4-inch thicknesses, with end walls 18 having 6-inch thicknesses. Top wall 12 may be variable in thickness, such having a 4-inch thickness at its lateral ends and a 6-inch thickness at its center, and bottom wall 14 typically will have a thickness of at least 4 inches. Again, these values are merely for purposes of illustration and values that are greater or less than these values may be used and are within the scope of the invention. Other illustrative wall configurations, as well as suitable methods for forming walls 12–18 are disclosed in the above-incorporated U.S. patent application Ser. No. 09/327,037.

Figure 10:
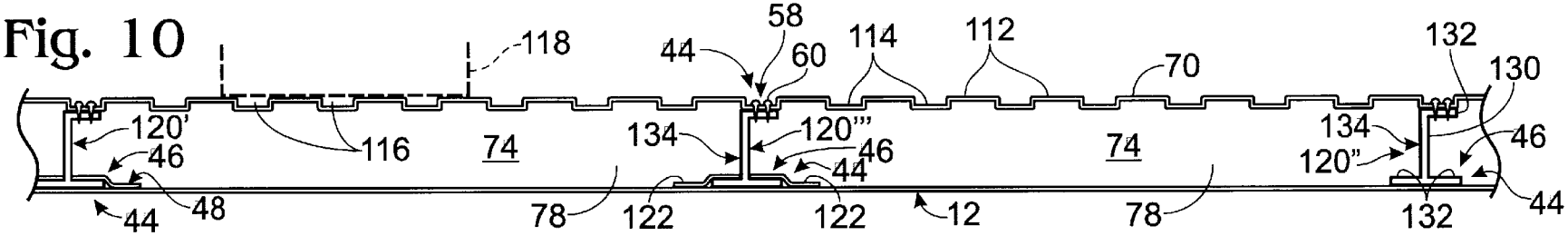
FIG. 10 is a fragmentary cross-sectional view taken along the line 10—10 in FIG. 1 and showing a suitable wall construction for the container of FIGS. 1–3.

In the previously discussed examples, layers 70 and 72, which form cavities 74 have been illustrated as having generally planar configurations other than at the joints 40 and adjacent portions. In some embodiments, it may be desirable for at least one of the layers, such as inner layer 70 to have a non-planar configuration, such as the stepped configuration shown in FIG. 10. Similar to the construction of surface 86, shown in FIG. 5, the embodiment of layer 70 shown in FIG. 10 has risers 112 and recessed portions 114. Such a configuration allows air to flow along layer 70 in the passages 116 formed between risers and recessed portions 114. Therefore, air or other gases may flow through compartment 20 and along surfaces 70, even if cargo to be transported is pressed against layer 70, such as schematically illustrated in FIG. 10 at 118. It should be understood that any suitable configuration the defines airflow passages 116 between risers and recessed portions may be used, such as sinusoidal or other arcuate configurations, as well as stepped configurations of different sizes, and projecting risers, such as shown in FIG. 5.

Also shown in FIG. 10 are stiffeners, or ribs, 120 that provide increased support to walls 12–18. In FIG. 10, ribs 120, which may also be referred to as reinforcing members, extend between surfaces 70 and 72. Ribs 120 may be secured to layers or other surfaces to which they are attached by any suitable fastening mechanism 44, including those discussed above with respect to joints 40. In FIG. 10 three illustrative examples are shown. As shown at rib 120', a non-penetrating fastening mechanism 46 in the form of an adhesive 48 is shown. Another example of a non-penetrating fastening mechanism is the composite fiberglass material itself, which can be bonded to itself prior to completely curing the material. When the material cures, the engaged portions are bonded together, such as shown at rib 120." As a further example, strips or lengths 122 of material 52 may be used to overlie the pieces to be joined together, such as shown at rib 120,'" which provides another example of a non-penetrating fastening mechanism 46. As discussed, penetrating fastening mechanisms 58 may also be used, such as screws 60, which are shown joining layer 70 to ribs 120.

In FIG. 10, layers 70 and 72 define pockets 74 that are filled with air or another gas 78. To increase the insulating value of the wall, the pockets are preferably sealed, or airtight. When it is not necessary to insulate the walls, the pockets may be open to permit air from the environment to enter the pockets. As discussed, pockets 74 may also be filled with other insulating materials, such as a solid (or foamed) insulating material 80, such as shown in FIG. 11.

Figure 11:
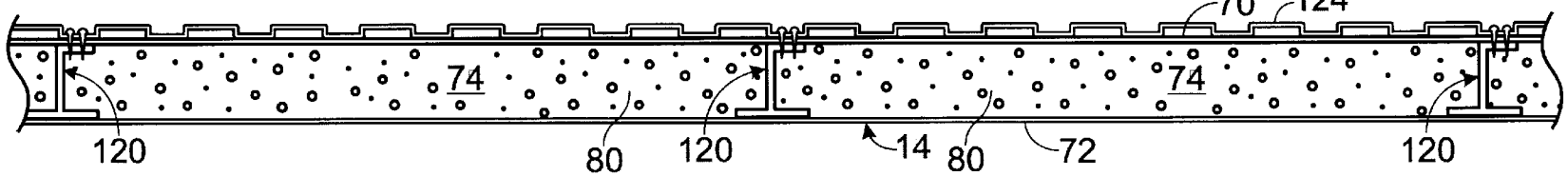
FIG. 11 is a fragmentary cross-sectional view showing another suitable wall construction.
Figure 13:
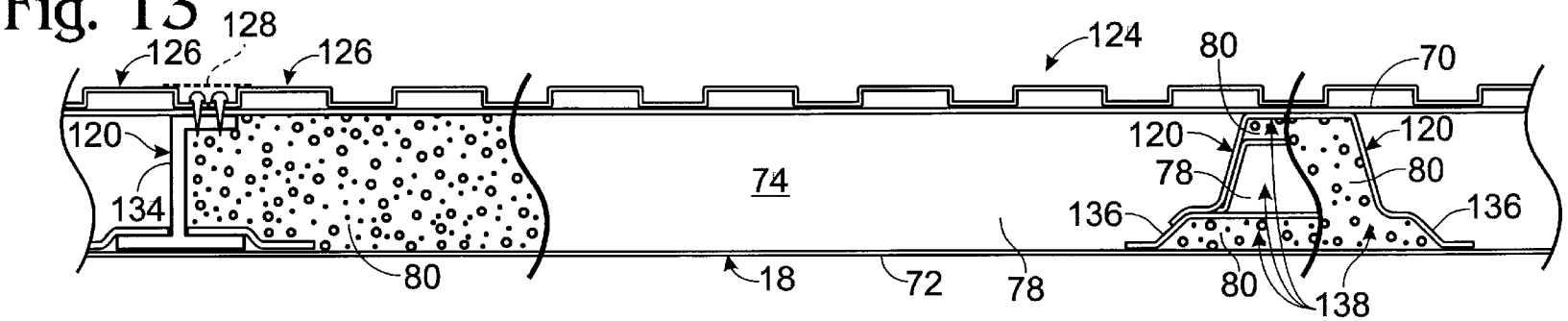
FIG. 13 is a fragmentary cross-sectional view showing other suitable wall constructions.

FIG. 11 also provides an illustrative example of a wall construction in which the wall includes a pair of inner layers 70 and 124. Both of layers 70 and 124 may be formed from material 52, or one or more of the layers may be formed of a different material, such as a thermoplastic material. In such a configuration, the innermost layer may be referred to as a liner. Such a layer may be formed as a single sheet, like layers 70 and 72 are typically formed, or may be applied to layer 70 in a plurality of segments, such as shown in FIG. 13 at 126. Also shown in dashed lines in FIG. 13 is a cover 128 that may be applied over penetrating fasteners 58. Cover may be preformed to fit between risers 112 or may be applied as an amorphous material that at least partially fills the space between the risers.

Figure 12:
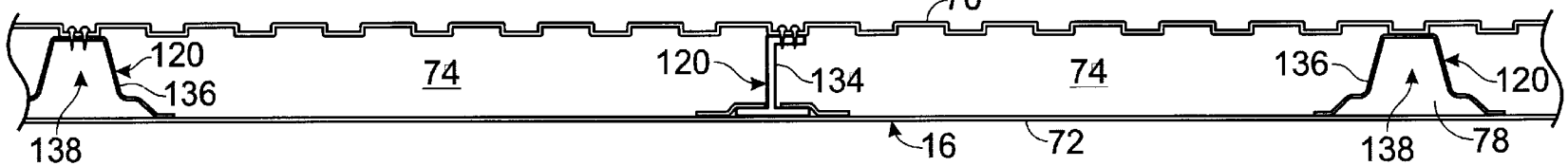
FIG. 12 is a fragmentary cross-sectional view showing another suitable wall construction.

In FIGS. 10 and 11, ribs 120 have a projecting member 130 that extends generally between layers 70 and 72, and stabilizers, or feet, 132 that project from one- or both-sides of the ends of projecting member 130. In this configuration, ribs 120 may be described as beams or bars 134 that extend between surfaces 70 and 72. It should be understood that ribs 120 may have a variety of configurations and should not be limited to the particular configuration shown in FIGS. 10 and 11. Furthermore, walls 12–18 may include a plurality of ribs having more than a single configuration. In FIG. 12, another example of a suitable configuration for ribs 120 is shown and generally indicated at 136. The illustrated configuration may be referred to as a hat or channel configuration because the ribs define internal channels 138. Channels 138 may be either sealed (or airtight) or open to the environment. Ribs 136 may also be described as extending from a first of layers 70 or 72, to the other layer, and then back to the first layer. In FIG. 12, the first layer is shown as layer 72, but it should be understood that it may alternatively be layer 70.

Similar to pockets 74, channels 138 may be filled with air or another gas 78 (such as shown in FIG. 12) or a solid or foamed material 80 (such as shown in FIG. 13). An advantage of a solid or foamed material is that it provides increased support to the wall and provides greater insulating value, especially if the channel is open to the environment. An advantage of an air- or gas-filled channel is that it is less expensive and heavy, and that it may be used as an airflow conduit to distribute heating or cooling air throughout container 10, as discussed in more detail herein. In FIG. 13, a further example of a suitable configuration for a rib 120 having hat- or channel-configuration 136 is shown. As shown, the rib includes a plurality of channels 138. Each of the channels may be filled with an insulating material, such as air or foam or another solid insulating material.

Figure 14:
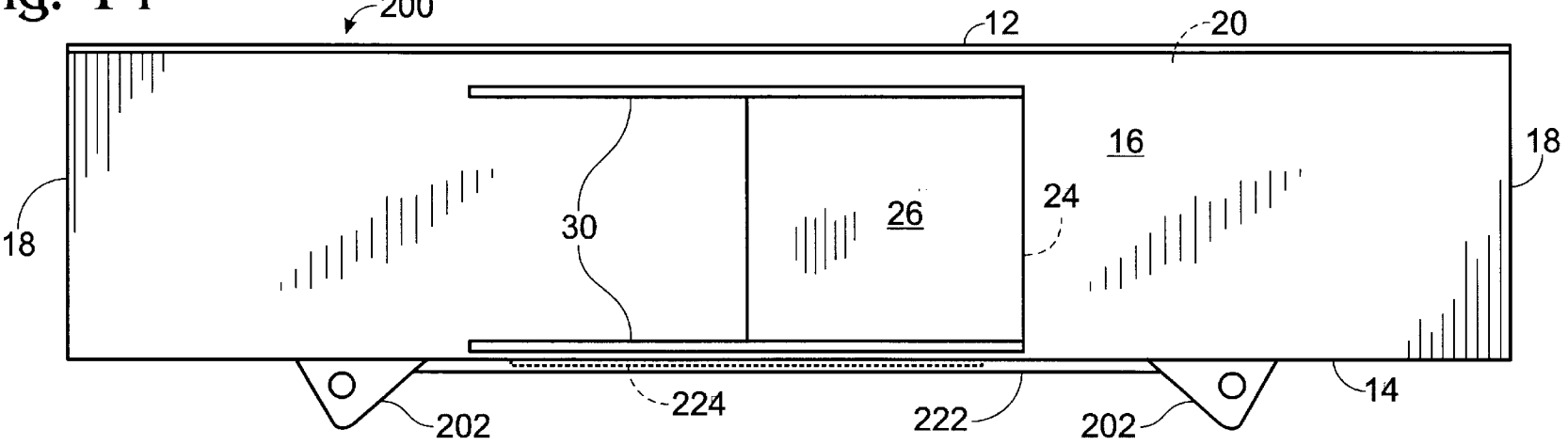
FIG. 14 is a side elevation view of another composite railcar container constructed according to the present invention.

Another container constructed according to the present invention is shown in FIG. 14 and generally indicated at 200. Container 200 is adapted for use in a well car, which as discussed has a container-supporting surface that is recessed into its frame. Accordingly, container 200 includes supports, or saddles, 202 that are adapted to support the body of the container, i.e., walls 12–18, near or above the upper surface of the frame of the well car to facilitate loading and unloading of cargo through opening 24. Saddles 202 may have any suitable configuration sized to support the container at the desired height within a well car. In FIG. 14, saddles 202 may extend substantially or completely across the width of the container, or alternatively two or more saddles may be used at each end region of the car. Similarly one or more additional saddle 202 may be used to support the container, such as intermediate the positions shown. Intermediate saddles especially may be used on longer containers to provide incremental support along bottom, or lower, wall 14.

Figure 15:
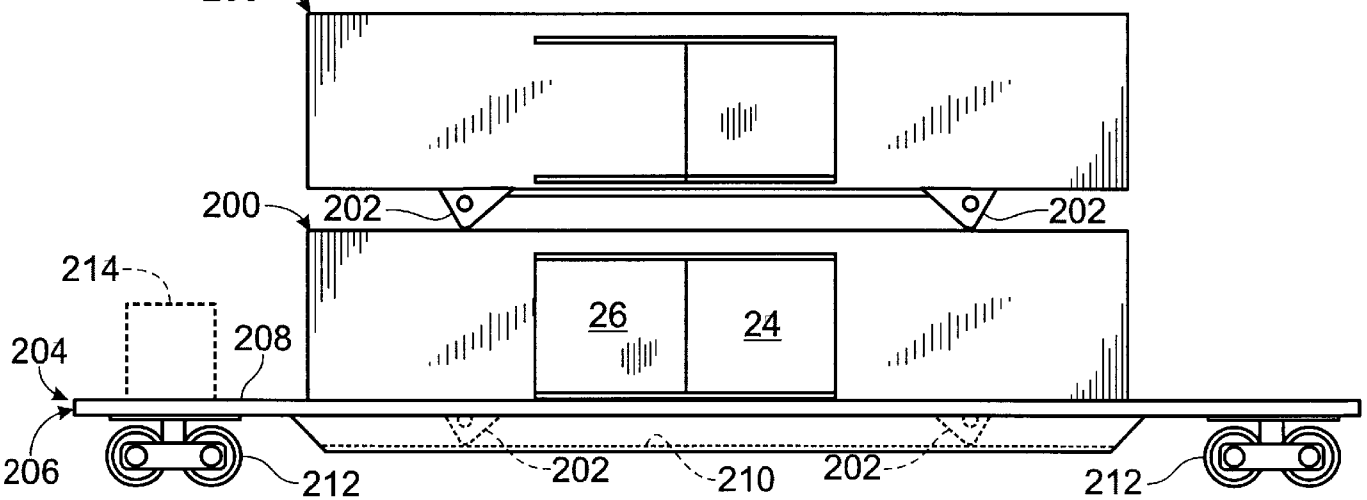
FIG. 15 is a side elevation view showing a pair of composite railcar containers according to the present invention mounted upon a railcar in the form of a well car.

This relationship is perhaps more clearly described with reference to FIG. 15, in which a well car has been illustrated at 204. As shown, well car 204 includes a frame 206 having an upper surface 208, a cargo-supporting surface 210 and a pair of wheel assemblies 212 that are mounted on frame 206 and are adapted to travel along rails. Not shown in FIG. 15 are the coupling structures that are used to connect well car 204 with other railcars. Well car 204 may, but does not necessarily, also include a refrigeration assembly 214, which is adapted to provide refrigerated air to containers supported on the car.

As shown in FIG. 15, container 200 is preferably supported on surface 210 so that the lower edge 216 of opening 24 is at or above upper surface 208. This configuration facilitates easier loading and unloading of container 200, especially when wheeled or driven vehicles or structures are used to transport the cargo. FIG. 15 also provides an illustrative example of a pair of containers, such as containers 200, that are stacked upon each other for transportation by a railcar, such as well car 206.

Also shown in FIG. 14 is a central support 222 that interconnects saddles 202. Support 222 may additionally or alternatively, underlie opening 24, and may include a support plate 224, such as a steel plate, to provide increased strength to the container at and around opening 24. Unless otherwise indicated, container 200 may have the same elements, subelements and variations as container 10 and the other containers discussed herein. Similarly, elements, subelements or variations that were not previously discussed may additionally or alternatively be used with the prior embodiments of containers according to the present invention.

Figure 16:
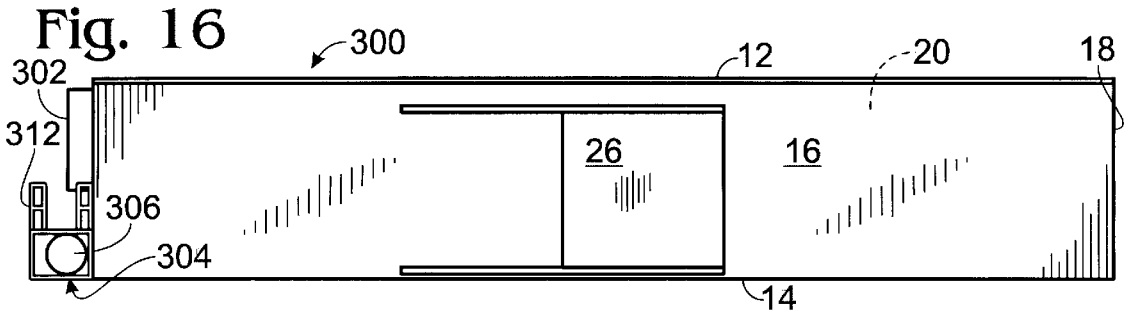
FIG. 16 is side elevation view of a refrigerated composite railcar container constructed according to the present invention.
Figure 17:
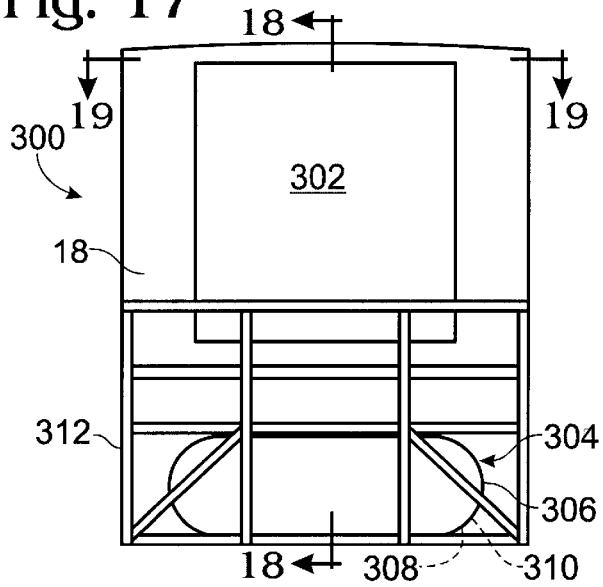
FIG. 17 is an end elevation view of the container of FIG. 16.

Another railcar container constructed according to the present invention is shown in FIGS. 16 and 17 and generally indicated at 300. Container 300 may be referred to as a temperature-controlled container because it includes a temperature control assembly 302. Assembly 302 may be adapted to produce heated, refrigerated or cryogenic air (or other gas) and distribute this air (or other gas) within the container to respectively heat, cool or freeze (or maintain frozen) the cargo within the container. It should be understood that assembly 302 includes various blowers or pumps, heating or cooling units, valve assemblies and the like, as are known in art. Depending upon the particular construction of assembly 302, container 300 may be referred to as a heated, refrigerated or cryogenic container. For purposes of brevity, assembly 302 will be described as producing an air stream in the following discussion. However, it should be understood that other gases may be used. For example, in a cryogenic container, assembly 302 may deliver a stream of liquid carbon dioxide under pressure to outlets or nozzles, which produce gaseous carbon dioxide and solid carbon dioxide, namely dry ice. An example of a suitable cryogenic temperature control assembly is disclosed in the above-incorporated U.S. patent application Ser. No. 09/327,037.

As shown in FIGS. 16 and 17, assembly 302 is mounted on end wall 18 of container 300. It should be understood that other mounting positions may be used, including positions within container 300. A benefit of mounting the assembly exterior the container is that it does not occupy cargo space within compartment 20 and may be accessed even when the compartment is completely loaded with cargo. As also shown in FIGS. 16 and 17, temperature control assembly includes a fuel supply 304, which supplies fuel to temperature control assembly 302. Fuel supply 304 may communicate and deliver fuel to assembly 302 through any suitable linkages and/or conduits. It is within the scope of the invention that temperature control assembly 302 may communicate with an external controller via any suitable form of one- or two-way communication linkage. Because of the mobile nature of railcars, typically a wireless communication linkage will be used, but wired communication linkages are still within the scope of the invention, such as to establish communication with other portions of a series of railcars, such as an engine or control car. One-way communication may enable a user to monitor the operation of assembly 302, including its operative state, the temperature at one or more locations within the container and the amount of fuel in the container. Two-way communication also enables the operation of the temperature control assembly to be controlled from a remote source.

As illustrated in FIGS. 16 and 17, and perhaps best seen in FIG. 17, fuel supply 304 includes a tank 306 of combustible fuel. It is within the scope of the invention that supply 304 may additionally or alternatively include a battery assembly 308 containing one or more batteries adapted to provide electrical power to the temperature control assembly, and/or a heating/cooling fluid supply 310 (such as a tank of air or other gas, liquid carbon dioxide, etc.). Also shown in FIGS. 16 and 17 is a platform 312 that facilitates easier access to assembly 302 by a user. Unless otherwise indicated, container 300 may have the same elements, subelements and variations as containers 10, 200 and the other containers discussed herein. Similarly, elements, subelements or variations that were not previously discussed may additionally or alternatively be used with the prior embodiments of containers according to the present invention.

Figure 19:
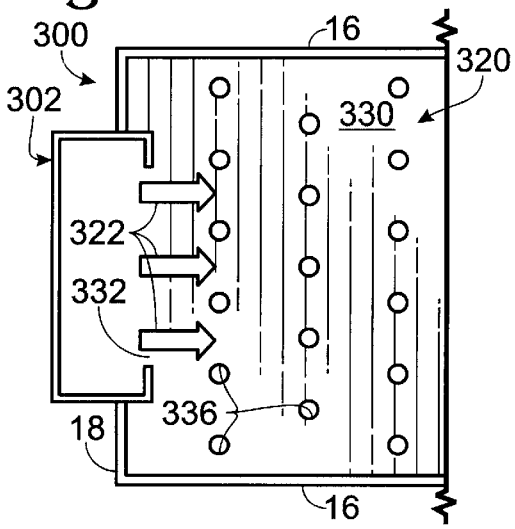
FIG. 19 is a fragmentary partial cross-sectional top plan view of the container of FIG. 16 taken along line 19—19 in FIG. 17.
Figure 18:
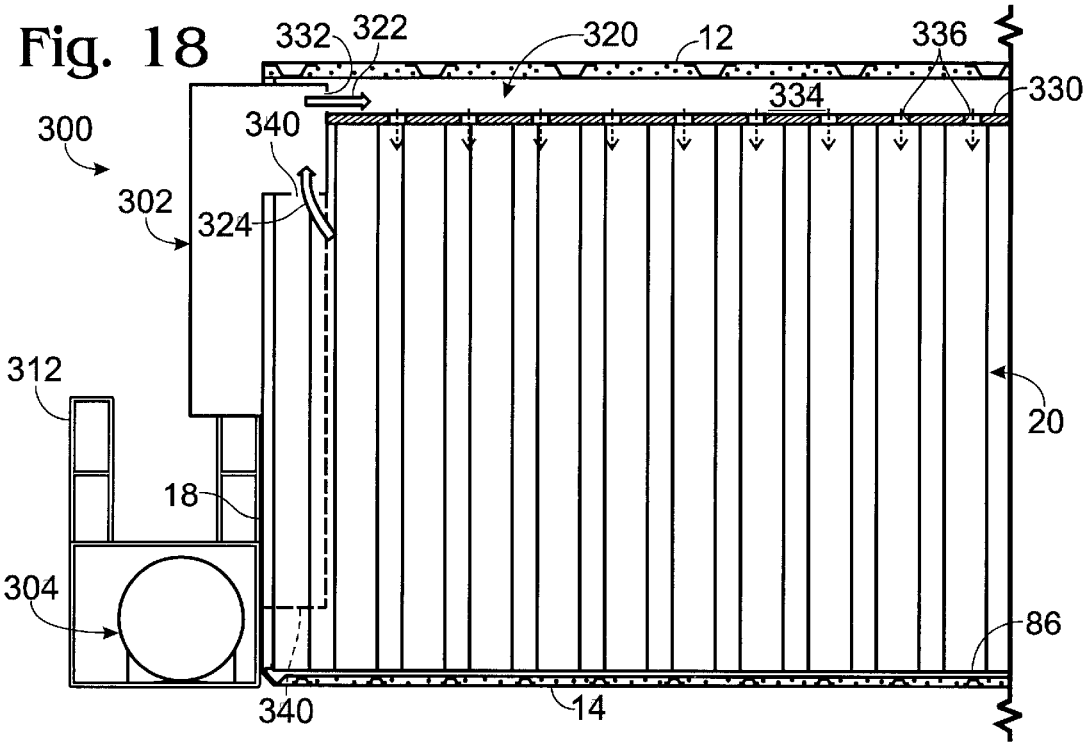
FIG. 18 is a fragmentary partial cross-sectional side elevation detail of the container of FIG. 16 taken along line 18—18 in FIG. 17.

As shown in FIGS. 18 and 19, container 300 preferably includes a distribution assembly 320 that communicates with temperature control assembly 302 to receive a stream 322 (of air of other heating/cooling fluid) therefrom and distribute the stream throughout the container, such as within compartment 20. The distribution assembly 320 may additionally provide a recycle stream 324 (or air other heating/cooling fluid) to temperature control assembly 302. Stream 322 may originate from a supply, such as supply 310, may be drawn from the environment that surrounds container 300, and/or may include recycle stream 324. A factor that may at least partially determine the source or sources for steam 322 is whether the distribution assembly is a closed or open system (meaning whether the assembly exhausts stream 322 to the environment or recycles the stream for storage or redistribution). A closed system tends to be more efficient than an open system, however, it requires additional ducting or other conduits to recycle the airflow. The source or sources for stream 322 may vary, such as in view of the particular temperature to be achieved, the temperature of the environment around container 300, and the range of temperatures within which the cargo within compartment 20 may be exposed.

In FIGS. 18 and 19, an illustrative example of a suitable distribution assembly 320 is shown. As shown, container 300 includes a partition, or false ceiling, 330 that is spaced apart from top wall 12. Temperature control assembly 302 exhausts a stream 322 above partition 330 from one or more outputs or ducts 332. With this construction, the cavity 334 above partition 330 functions as a distribution manifold in that air or other fluid forming stream 322 travels within the cavity and is distributed into compartment 20 through a plurality of apertures, vents or other air-passages 336 that are spaced along partition 330.

In the illustrated embodiment, a plurality of spaced-apart apertures are shown, although it should be noted that the size of the apertures has been exaggerated for purposes of illustration. It should be understood that the size, number and distribution of apertures 336 may vary. For example, the size of the container, and flow rate of stream 322 may affect the optimal spacing and size of the apertures. Furthermore, the size and spacing of the apertures are related in that the apertures may be spaced further apart from each other as the size of the apertures increases, and vice versa. Preferably, the apertures are sized and spaced so that stream 322 is distributed the entire length along cavity 334. Another way of describing this configuration is that the size and spacing of the apertures is selected so that stream 322 is distributed to maintain a uniform or generally uniform temperature along the length of the container. In experiments, 0.5-inch diameter apertures spaced approximately 12 inches apart has provided a suitable distribution pattern, but others may be used, as discussed above.

In FIG. 18, recycle stream 324 is shown being drawn into one or more is intakes 340 in temperature control assembly 302. The position of intake 340 is shown in both solid and dashed lines in FIG. 18 to illustrate that the position may vary. For example, the position shown in solid lines draws air from the upper portion of compartment 20 and provides a more compact temperature control assembly, while the position shown in dashed lines draws air from the lower portion of the compartment. It should be understood that assembly 302 may be formed without an intake inside compartment 320 if stream 322 is exhausted from compartment 20 instead of being recycled.

Figure 20:
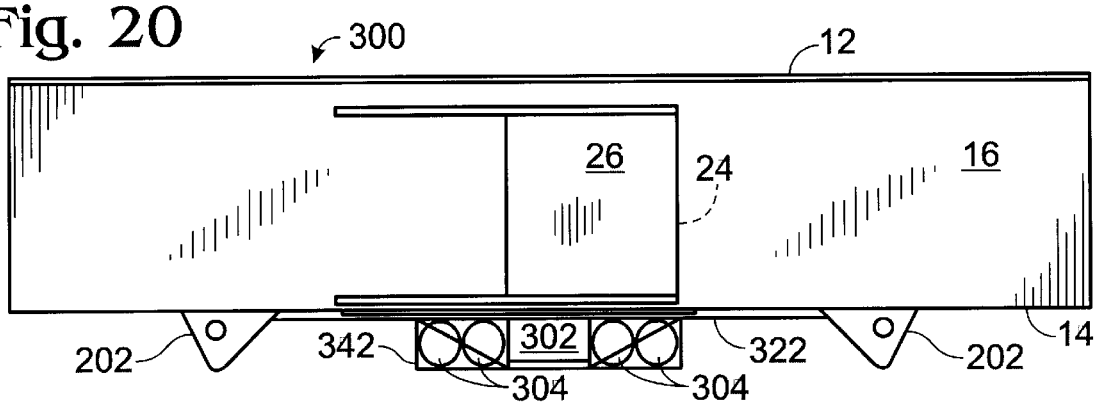
FIG. 20 is a side elevation view of another refrigerated composite railcar container constructed according to the present invention.

As discussed previously, temperature control assembly 302 may be mounted on container 300 in positions other than on end wall 18. An example of such a configuration is shown in FIG. 20, in which container 300 is adapted for use in a well car, and as such includes saddles 202. As shown, temperature control assembly 302 is mounted on the underside of the container. In the particular embodiment shown, assembly 302 is mounted beneath opening 24, but other positions may be used. Also shown is a housing 342 into which assembly 302 and fuel supply 304 are enclosed, such as to provide support and protection for these components. Housing 342 may also be constructed of sufficient strength that it provides support to container 300 intermediate the support provided by saddles 202, such as against a container-supporting surface or the upper wall of a container on which container 300 is mounted.

Another example of a suitable distribution assembly 320 is shown in FIG. 21. As discussed previously, ribs 136 may include channels 138 that define fluid conduits through which at least one of streams 322 and 324 may flow. In FIG. 21, rib 136' is shown defining a fluid conduit 350 that extends from bottom wall 14, along end wall 18 and to an outlet 352 from which stream 322 is exhausted. Once exhausted from outlet 352, stream 322 is distributed along cavity 334 and passes through apertures 336 into compartment 20. In this configuration, rib 136' is in fluid communication with temperature control assembly 302 to receive stream 322 therefrom. The use of ribs or channels that extend through the walls of the containers as fluid conduits enables temperature control assembly 302 to be housed in a position on or near container 300 so that the assembly itself does not need to extend into the compartment. For example, refrigeration assembly 214, such as shown in FIG. 15, may communicate with rib 136' to deliver stream 322 thereto and thereby distribute the stream throughout compartment 20.

A benefit of an onboard temperature control assembly is that the container may be maintained at the desired temperature or range of temperatures even after the container is removed from the railcar on which it is transported. In other words, the temperature control assembly is integrated with the container and may be used to control the temperature of the container even when the container is loaded onto other transport structures, such as semi trucks, seacraft and the like, or when the container is stored apart from a railcar or external source of refrigeration or other climate-control device. This may be particularly useful in environments where heated, refrigerated or cryogenic storage facilities do not exist or are not available to receive the cargo from the container. As such, container 300 may be described as being or containing a stand-alone refrigeration, heating, or cryogenic unit.

In the embodiment shown in FIG. 21, ribs 136" may also be used to distribute stream 322. Alternatively channels 138 in ribs 136" may be used to recycle stream 324 to temperature control assembly 302, or to deliver a supply of air or other fluid from an external source to assembly 302. When ribs 136" are used to recycle stream 324 to assembly 302 or to exhaust stream 324 from container 300, the ribs communicate with an intake positioned to receive the stream from one or more selected positions within compartment 20. Streams 324 may be drawn into ribs 136" on account of a pressure gradient within the container, or a pump, fan or other suitable transport mechanism may be used. As shown on the left side of FIG. 21, partition 330 may be supported by a ledge 353 formed in sidewalls 16. Alternatively, the partition may be mounted on the sidewalls or other support structure by any suitable fastening mechanism 44.

It should be understood that distribution assembly 320 may be formed without a partition 330. An example of such a configuration is shown on the right side of FIG. 21, in which rib 136'" extends along surface 70 of top wall 12 to distribute stream 322 throughout compartment 20. Rib 136'" preferably contains perforations or other apertures along its length that are sized and spaced to produce the desired distribution of stream 322, as discussed herein. Although only a single rib 136'" is shown in FIG. 2, more than one such rib may be used, such as two or more ribs spaced apart along surface 70 and extending along at least a substantial portion, or the complete length, of compartment 20. Another suitable position for rib 136'" is shown in dashed lines on the right side of FIG. 21. A benefit of positioning a rib, such as rib 136'" that is open to compartment 20 at or near the corner of the compartment is that fork lifts and other cargo-transporting equipment are less likely to strike the ribs and potentially damage the ribs or other portions of the container. It should be noticed that the rib shown in dashed lines in FIG. 21 defines a channel or fluid conduit 138 but has a different configuration from ribs 136' and 136," thereby further demonstrating that the configurations of the ribs may vary within the scope of the present invention.

Figure 22:
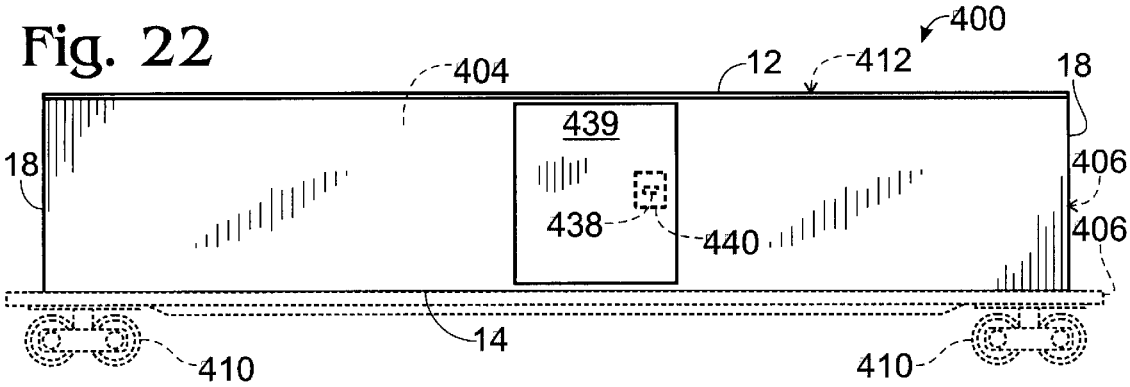
FIG. 22 is a fragmentary side elevation view of a railcar or railcar container with a pocket door constructed according to the present invention.

Another container according to the present invention is shown in FIG. 22 and generally indicated at 400. Unlike doors 26 shown and described in the preceding figures, container 400 includes a pocket door 402. By "pocket door," it is meant that door 402 is a door that slides between the closed position shown in FIG. 22, in which opening 24 is obstructed or completely sealed, and an open position, in which at least a substantial portion of door 402 or the complete door 402 is housed within a pocket, or recess, 404 formed in the sidewall of the container. Unless otherwise indicated, container 400 may have the same elements, subelements and variations as containers 10, 200 and 300 discussed herein.

The following discussion will describe pocket door 402 in the context of a container according to the present invention. It should be understood, however, that is it within the scope of the present invention that door 402 may be used with conventional railway and other shipping containers. Similarly, and as indicated in dashed lines in FIG. 22, pocket door 402 may be used on conventional boxcars 406 in place of the conventional door described herein and illustrated at 26. Boxcar, or other railcar, 406 typically includes a frame 408 having at least a pair of wheel assemblies 410 and a storage compartment 412 into which cargo to be transported may be stored.

Figure 23:
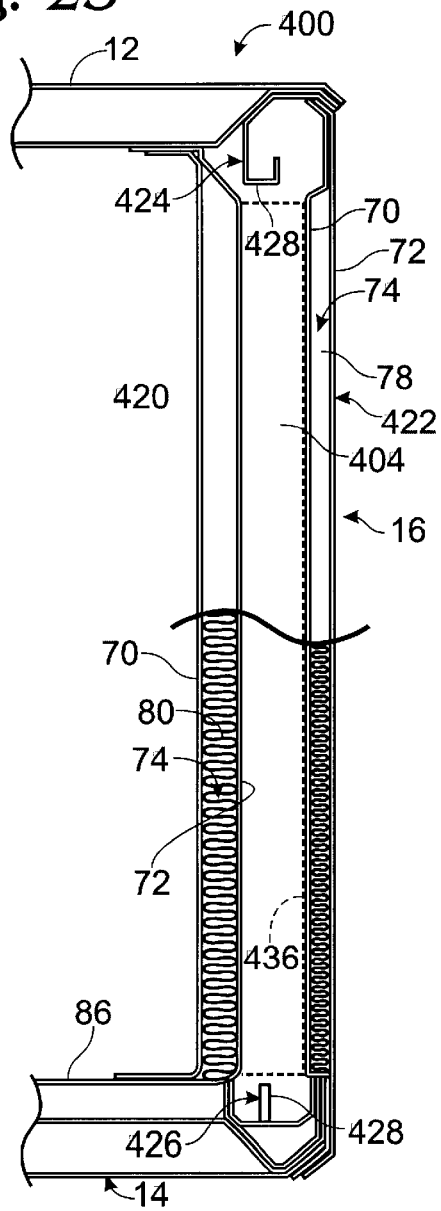
FIG. 23 is a cross-sectional view of the pocket formed in the railcar or railcar container of FIG. 22.
Figure 24:
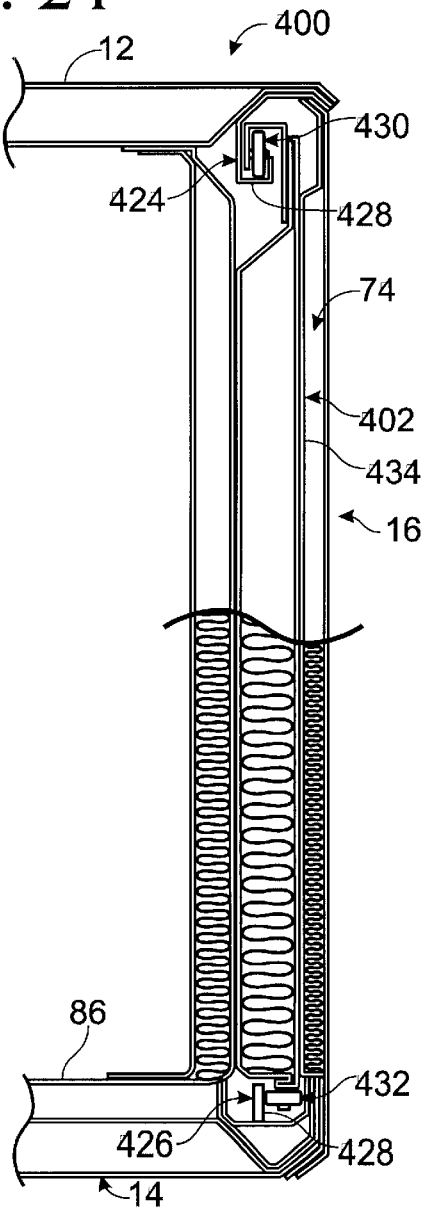
FIG. 24 is a cross-sectional view of the pocket and pocket door of FIG. 22.

In FIG. 23, pocket or recess 404 is shown in more detail and extends between portions 420 and 422 of sidewall 16. Portions 420 and 422 are formed from layers 70 and 72 of material 52 and define cavities 74 therebetween. Cavities 74 may be filled with air, or a solid or foamed material, such as shown in FIG. 23 and may be closed or open to the environment. Also shown in FIG. 23 are tracks, or guides, 424 and 426 that define the slidable path of door 402 between its open and closed configurations. Guides 424 and 426 provide mounts 428 for wheel or roller assemblies 430 and 432, which are shown in FIG. 24 and which are configured to travel along the tracks as the door is slid between its open and closed configurations.

Preferably, door 402 forms an airtight seal when in its closed position, with outer surface 434 of the door being flush with the outer surface of sidewall 16. However, it should be understood that less-than-airtight fits are within the scope of the invention. It should be understood that pocket 404 may include one or more baffles 436 that are biased to divide the airspace within the pocket when the door is closed, thereby providing additional insulating value to the container. When the door is opened, the baffles retract or otherwise deform or deflect out of the path of the door. However, when the door is closed, the baffles return toward the position shown in FIG. 23.

As illustrated in FIG. 22, door 402 preferably includes a handle 438 by which a user may selectively open and close the door. One suitable form of handle is a handle recessed into outer surface 439 of the door. The door may also include a lock mechanism 440 that selectively secures the door in its closed position, such as to prevent unauthorized access to compartment 20 and/or to prevent unintentional opening of door 402. For example, selective rotation of the handle may cause lock mechanism 440 to be selectively engaged or disengaged. It should be understood that lock mechanism 440 is schematically illustrated in FIG. 21. An example of a suitable lock mechanism includes at least one of an upper and a lower steel or other structural member that selectively are received into receptacles in the container's wall panel to prevent the door from being moved from the locked position. Other lock mechanisms 440 may be used and are within the scope of the invention.

Door 402 may be formed of any suitable material, including steel or other metal constructions. Door 402 may alternatively, or additionally, be formed of composite fiberglass material 52 and may also include an insulating material, such as shown in FIG. 24.

INDUSTRIAL APPLICABILITY

The present invention is applicable to the railcar and shipping industries, and especially as they relate to railcar and shipping containers and doors for containers and railcars.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A composite railway container, comprising:

a pair of spaced-apart end walls at least partially formed from a composite fiberglass material;

a pair of sidewalls at least partially formed from a composite fiberglass material;

a top wall at least partially formed from a composite fiberglass material;

a bottom wall adapted to be supported on a railcar, wherein the end walls, sidewalls, top wall and bottom wall are interconnected to form a railway container that defines a compartment adapted to receive cargo to be transported in the container, and further wherein at least one of the walls includes an opening through which cargo may be loaded and unloaded from the container, and further wherein the at least one of the walls includes spaced-apart inner and outer portions that define a pocket therebetween adjacent the opening; and a door adapted to move between a closed position, in which the door obstructs the opening, and an open position, in which the opening is at least substantially unobstructed by the door and the door is at least substantially received within the pocket.

2. The container of claim 1, wherein the bottom wall is at least partially formed from a composite fiberglass material.

3. The container of claim 1, wherein at least one of the walls is at least substantially formed from a composite fiberglass material.

4. The container of claim 1, wherein at least one of the walls is completely formed from a composite fiberglass material.

5. The container of claim 1, wherein at least two of the walls include layers of composite fiberglass material that are spaced apart from each other to define a cavity therebetween.

6. The container of claim 5, wherein the cavity is airtight.

7. The container of claim 5, wherein the cavity is filled with an insulating material.

8. The container of claim 5, wherein the cavity includes a plurality of ribs extending between the layers.

9. The container of claim 8, wherein at least one of the plurality of ribs includes an internal channel.

10. The container of claim 9, wherein the internal channel includes a fluid conduit.

11. The container of claim 10, wherein the internal channel includes an insulating material.

12. The container of claim 1, wherein each of the walls includes layers of composite fiberglass material that are spaced apart from each other to define a cavity therebetween.

13. The container of claim 1, wherein each of the walls is separately formed as a discrete unit from the other walls.

14. The container of claim 2, wherein each of the walls includes perimeter portions, and further wherein the container includes at least one fastening mechanism interconnecting the perimeter portions of each of the walls with the perimeter portions of at least four of the other walls.

15. The container of claim 14, wherein the at least one fastening mechanism includes at least one penetrating fastening mechanism.

16. The container of claim 14, wherein the at least one fastening mechanism includes at least one non-penetrating fastening mechanism.

17. The container of claim 14, wherein the at least one fastening mechanism includes at least one penetrating fastening mechanism and at least one non-penetrating fastening mechanism.

18. The container of claim 1, wherein the bottom wall is adapted to support a load of at least 30,000 pounds per square foot.

19. The container of claim 18, wherein the bottom wall is adapted to support a load of at least 60,000 pounds per square foot.

20. The container of claim 19, wherein the bottom wall is adapted to support a load of at least 90,000 pounds per square foot.

21. The container of claim 1, wherein the bottom wall includes a plurality of saddles extending from the bottom wall of the container to support the container on a railcar.

22. The container of claim 1, wherein the at least one of the walls further includes at least one deflectable baffle that is biased to extend between the inner and outer portions of the wall, wherein when the door is in the closed position the baffle extends between the inner and outer portions of the at least one wall, and further wherein when the door is in the closed position the baffle is deflected away from at least one of the inner and outer portions as the door extends into the pocket.

23. The container of claim 1, wherein the at least one of the walls further includes guides extending within the pocket and adapted to guide the movement of the door into and out of the pocket as the door travels between its open and closed positions.

24. The container of claim 1, wherein the door is at least partially formed of a composite fiberglass material.

25. The container of claim 1, wherein the container further includes a temperature control assembly adapted to maintain the compartment at a predetermined temperature or range of temperatures.

26. The container of claim 25, wherein the temperature control assembly is adapted to deliver refrigerated air to the compartment.

27. The container of claim 25, wherein the temperature control assembly is mounted on the container.

28. The container of claim 25, wherein the temperature control assembly is integrally formed with the container.

29. The container of claim 25, wherein the temperature control assembly is adapted to deliver heated air to the compartment.

30. A modular railway container, comprising:

a plurality of walls that each are at least partially formed from a composite fiberglass material; wherein each of the walls includes a perimeter portion, and further wherein each of the walls is formed as a discrete unit from the other walls; and at least one fastening mechanism adapted to secure the perimeter portions of selected ones of the walls together to form a railway container having an internal compartment adapted to receive cargo to be transported in the container, wherein each of the walls includes an inner surface that defines a portion of the internal compartment, wherein each of the walls includes an outer surface that defines a portion of an exterior surface of the container, and further wherein the walls are adapted to be interconnected by the at least one fastening mechanism without requiring a frame to support the walls.

31. The container of claim 30, wherein at least one of the walls is completely formed of a composite fiberglass material.

32. The container of claim 30, wherein each of the walls includes at least a pair of layers of composite fiberglass material.

33. The container of claim 30, wherein each of the walls includes a cavity filled with an insulating material.

34. The container of claim 33, wherein each of the walls includes a plurality of ribs extending within the cavity.

35. The container of claim 34, wherein at least one of the plurality of ribs includes an internal channel.

36. The container of claim 35, wherein the internal channel includes a fluid conduit.

37. The container of claim 36, wherein the internal channel includes an insulating material.

38. The container of claim 30, wherein at least one of the walls includes an opening, through which cargo may be loaded into and removed from the internal compartment, and spaced-apart inner and outer portions adjacent the opening that define a pocket therebetween, and further wherein the container includes a door adapted to selectively close the opening, wherein the door is adapted to move between a closed position, in which the door obstructs the opening, and an open position, in which the opening is at least substantially unobstructed by the door and the door is at least substantially received within the pocket.

39. The container of claim 35, wherein the at least one of the walls that contains the opening further includes at least one deflectable baffle that is biased to extend between the inner and outer portions of the wall, wherein when the door is in the closed position the baffle extends between the inner and outer portions of the at least one wall, and further wherein when the door is in the closed position the baffle is deflected away from at least one of the inner and outer portions as the door extends into the pocket.

40. The container of claim 30, wherein the at least one fastening mechanism includes at least one penetrating fastening mechanism.

41. The container of claim 30, wherein the at least one fastening mechanism includes at least one non-penetrating fastening mechanism.

42. The container of claim 30, wherein the at least one fastening mechanism includes at least one penetrating fastening mechanism and at least one non-penetrating fastening mechanism.

43. The container of claim 30, further comprising a bottom wall that is adapted to support a load of at least 30,000 pounds per square foot.

44. The container of claim 43, further comprising a bottom wall that is adapted to support a load of at least 60,000 pounds per square foot.

45. The container of claim 44, further comprising a bottom wall that is adapted to support a load of at least 90,000 pounds per square foot.

46. The container of claim 30, further comprising a bottom wall and a plurality of saddles that extend from the bottom wall of the container and are configured to support the container on a railcar.

47. The container of claim 30, wherein the container further includes a temperature control assembly adapted to maintain the compartment at a predetermined temperature or range of temperatures.

48. The container of claim 47, wherein the temperature control assembly is adapted to deliver refrigerated air to the compartment.

49. The container of claim 47, wherein the temperature control assembly is mounted on the container.

50. The container of claim 47, wherein the temperature control assembly is integrally formed with the container.

* * * * *

UNITED STATES PATENT AND TRADEMARK OFFICE

CERTIFICATE OF CORRECTION

PATENT NO. : 6,615,741 B2 
DATED : September 9, 2003
INVENTOR(S) : Joseph V. Fecko, William R. Galbraith and Kurt Jordan It is certified that error appears in the above-identified patent and that said Letters Patent is hereby corrected as shown below:

Column 18,
Line 25, after "The container of claim" please delete "35" and insert -- 38 -- therefor.

Signed and Sealed this

Twenty-third Day of December, 2003

JAMES E. ROGAN
*Director of the United States Patent and Trademark Office*